US010109160B1

(12) United States Patent
Blower et al.

(10) Patent No.: US 10,109,160 B1
(45) Date of Patent: Oct. 23, 2018

(54) SHUTTER ASSEMBLY FOR AN AUTOMATED TELLER MACHINE

(71) Applicant: International Business Machines Corporation, Armonk, NY (US)

(72) Inventors: Dave Blower, Greenford (GB); Simon James Forsdyke, Loughton (GB); Luke Tombs, San Ramon, CA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/723,331

(22) Filed: Oct. 3, 2017

(51) Int. Cl.
*G07D 11/00* (2006.01)
*G07F 19/00* (2006.01)

(52) U.S. Cl.
CPC ..... *G07F 19/205* (2013.01); *G07D 11/009* (2013.01); *G07D 11/0018* (2013.01); *G07D 11/0081* (2013.01)

(58) Field of Classification Search
CPC ..... G07D 11/0018; G07D 11/0081; G07D 11/009; G07F 7/04; G07F 19/20; G07F 19/205; G07F 19/2055
USPC ..... 194/344, 351
See application file for complete search history.

(56) References Cited

U.S. PATENT DOCUMENTS 4,848,873 A 7/1989 Villar
5,721,420 A 2/1998 May
6,076,648 A * 6/2000 Hatamachi ..... G07D 7/00 194/206
6,315,194 B1 11/2001 Graef et al.
6,536,662 B1 3/2003 Ohno
7,249,999 B2 * 7/2007 Malcolm ..... G07D 1/00 453/49
7,284,692 B1 10/2007 Douglass
(Continued)

FOREIGN PATENT DOCUMENTS

CN 1858811 11/2006
CN 100545877 9/2009
(Continued)

OTHER PUBLICATIONS

U.S. Appl. No. 15/723,584, filed Oct. 3, 2017.
(Continued)

*Primary Examiner* — Mark J Beauchaine
(74) *Attorney, Agent, or Firm* — Schmeiser, Olsen & Watts, LLP; Mark Vallone

(57) ABSTRACT

A dispenser shutter assembly for an automated teller machine and an associated method of preventing damage to a shutter operating mechanism of the dispenser shutter assembly. The dispenser shutter assembly includes: a frame member; a shutter plate; and a shutter operating mechanism that includes a motor assembly including a drive shaft mounting a worm gear and attached to the frame member by a pivotable mounting. The worm gear is moveable out of engagement with the worm segment by pivoting the motor assembly away from the frame member about the pivotable mounting. When the shutter plate is subject to an external force for moving the shutter plate to open a shutter from a closed position, the external force thereby applied to the worm gear by the worm segment moves the worm gear about the pivotable mounting out of engagement with the worm segment thereby preventing damage to the shutter operating mechanism.

9 Claims, 7 Drawing Sheets

(56) References Cited

U.S. PATENT DOCUMENTS

| | | | | |
|---|---|---|---|---|
| 7,344,065 | B1 | 3/2008 | Graef | |
| 7,494,053 | B1 | 2/2009 | Burns | |
| 7,503,446 | B2 * | 3/2009 | Yoshioka | G07D 11/0018 194/203 |
| 7,523,857 | B1 | 4/2009 | Graef | |
| 7,780,083 | B2 | 8/2010 | Schliebe et al. | |
| 2005/0173659 | A1 | 8/2005 | Jespersen et al. | |
| 2005/0269345 | A1 | 12/2005 | Sommerville | |
| 2005/0284925 | A1 | 12/2005 | Ahn et al. | |
| 2008/0136657 | A1 | 6/2008 | Clark et al. | |
| 2008/0142583 | A1 | 6/2008 | Yokoi et al. | |
| 2012/0160860 | A1 | 6/2012 | Milne et al. | |
| 2014/0151450 | A1 | 6/2014 | Lewis et al. | |
| 2015/0068863 | A1 | 3/2015 | Blower et al. | |
| 2017/0206731 | A1 | 7/2017 | Blower et al. | |

FOREIGN PATENT DOCUMENTS

| | | |
|---|---|---|
| CN | 101030308 | 10/2010 |
| CN | 101881840 | 11/2010 |
| CN | 102842014 | 12/2012 |
| DE | 102009003685 | 9/2010 |
| EP | 0965960 | 12/1999 |
| EP | 2648168 | 9/2013 |
| GB | 2414104 | 3/2006 |
| JP | H09134463 | 5/1997 |
| JP | H09185749 | 7/1997 |
| JP | 92006313398 | 11/2006 |
| JP | 2010224737 | 10/2010 |
| WO | WO2006079769 | 3/2006 |
| WO | 2008043995 | 4/2008 |
| WO | 2008057057 | 5/2008 |

OTHER PUBLICATIONS

Money Pass, The Nation's fastest-growing surcharge-free network,
'Cash claw' fraud on the rise in London, Nov. 29, 2012, Retrieved from internet on Nov. 19, 2013, URL: http://www.atmmarketplace.com/article/204495/-Cash-claw-fraud-on-the-rise-in-London, 3 pages.
CENNOX, The ASD-8 Anti-Skimming Device & Trial Proposal, Mar. 7, 2013, www.cennox.com, 7 pages.
Emma Reynolds, Mail Online, Beware the cash trap! Claw-like devices inserted into ATM slots can steal notes in latest hole-in-the-wall scam, Retrieved from internet on Nov. 19, 2013, 6 pages.
Anti-Cash-Trapping Solutions, retrieved from Internet: URL: http://www.wincor-nixdorf.com/internet/cae/servlet/contentblob/1182982/publicationFile/89608/AntiCashTrapping_DataSheet_EN.pdf, 2 pages.
International Search Report—PCT (dated Oct. 22, 2014), Applicants file Reference Gb130082, International Application No. PCT/IB2014/060429, 10 pages.
Office Action (dated Mar. 12, 2015) for U.S. Appl. No. 14/461,768, filed Aug. 18, 2014.
Amendment (dated Jun. 12, 2015) for U.S. Appl. No. 14/461,768, filed Aug. 18, 2014.
Office Action (dated Oct. 8, 2015) for U.S. Appl. No. 14/461,768, filed Aug. 18, 2014.
Amendment (dated Jan. 6, 2016) for U.S. Appl. No. 14/461,768, filed Aug. 18, 2014.
Final Office Action (dated May 4, 2016) for U.S. Appl. No. 14/461,768, filed Aug. 18, 2014.
Final Amendment (dated Jul. 5, 2016) for U.S. Appl. No. 14/461,768, filed Aug. 18, 2014.
Advisory action (dated Jul. 4, 2016) for U.S. Appl. No. 14/461,768, filed Aug. 18, 2014.
RCE (dated Aug. 4, 2016) for U.S. Appl. No. 14/461,768, filed Aug. 18, 2014.
Office Action (dated Sep. 8, 2016) for U.S. Appl. No. 14/461,768, filed Aug. 18, 2014.
Amendment (dated Dec. 5, 2016) for U.S. Appl. No. 14/461,768, filed Aug. 18, 2014.
Notice of Allowance (dated Jan. 27, 2017) for U.S. Appl. No. 14/461,768, filed Aug. 18, 2014.
Patent application for U.S. Appl. No. 15/623,868, filed Jun. 15, 2017.
Reply to UK examination report, Application No. GB1611909.1, 2 pages , dated Jun. 1, 2017.
Combined Search and Examination Report, Application No. GB1611909.1, dated Jan. 23, 2017, 6 pages.
"Motorised Shutter Control—Chapter 12.3" source and author unknown. See Functional Descdption, 12.3-1 to 12.3-3 iri patiicular. Dated Mar. 2000. URL: http://leoromo.net/docs/cajero/personas/rnotmised%2Oshutter%20contro.pdf, 28 pages.
RCE (dated Oct. 2, 2017) U.S. Appl. No. 15/475,333, filed Mar. 31, 2017.
Notice of Allowance (dated Jul. 6, 2017) U.S. Appl. No. 15/475,333, filed Mar. 31, 2017,
JP 3128253U, Toutsushi prevention device in the automated teller machine, 7 Pages, Jan. 11, 2007.
JPO Office Action IDS, dated Feb. 13, 2018, 1 Page.

* cited by examiner

*Figure 1* (Prior Art)

*Figure 2* (Prior Art)

*Figure 3* (Prior Art)

SHUTTER ASSEMBLY FOR AN AUTOMATED TELLER MACHINE

TECHNICAL FIELD

The present invention relates to automated teller machines, and in particular relates to a dispenser shutter assembly for an automated teller machine that includes a mechanism to prevent damage to the dispenser shutter assembly during manual opening of the shutter of the dispenser shutter assembly.

BACKGROUND

Automated banking machines are well known. A common type of automated banking machine used by consumers is an automated teller machine ("ATM"), colloquially known by terms such as "cash dispenser", "cash machine" or "hole-in-the-wall". ATMs enable customers to carry out banking transactions. Common banking transactions that may be carried out with ATMs include the dispensing of cash in the form of paper currency, the receipt of deposits, the transfer of funds between accounts, the payment of bills, account balance inquiries and mobile phone top-up etc. The types of banking transactions a customer can carry out are determined by capabilities of the particular banking machine and the institution offering the service.

In the United Kingdom there are around seventy thousand ATMs and this number is on the increase. ATM fraud is also on the increase and perpetrators are constantly devising new ways in which to fraudulently extract cash from inside ATMs. One method in which perpetrators attempt to extract cash from an ATM is by using a cash capture device. A cash capture device is inserted by the perpetrator in to a cash dispensing slot such that the cash is intercepted by the cash capture device inside the ATM and not dispensed to a user who has requested the cash. The perpetrator then returns to the ATM to remove the cash that is retained inside the ATM. During the removal operation, the perpetrator forces open the shutter of the ATM from the closed position. In some designs of ATM, the forcing open of the shutter damages the shutter operating mechanism so that the ATM is disabled, which requires intervention by a service engineer before the ATM can return to service.

It would be desirable to provide a solution which prevents the disabling of the ATM by the shutter forcing operation, so that the fraudulent activity does not result in an unserviceable ATM.

SUMMARY

The present invention provides a dispenser shutter assembly for an automated teller machine (ATM) and an associated method of preventing damage to a shutter operating mechanism of the dispenser shutter assembly. The dispenser shutter assembly includes: a frame member; a shutter plate operable for moving between a closed position of a shutter and an open position of the shutter; and a shutter operating mechanism. The shutter operating mechanism includes: a shutter operating motor assembly including a motor comprising a drive shaft mounting a worm gear; and a shutter plate. The shutter operating motor assembly is attached to the frame member by an attachment means. The shutter plate is moveable relative to the frame member and includes a worm segment. The worm segment is engageable with the worm gear so that, upon the worm segment being engaged with the worm gear and the worm gear being rotated by the motor, the worm segment and shutter plate are moveable between a closed position of the shutter and an open position of the shutter by sufficient rotation of the worm gear. The attachment means includes a pivotable mounting to the frame member so that the worm gear is moveable out of engagement with the worm segment by pivoting of the motor assembly away from the frame member about the pivotable mounting, so that when the shutter plate is subject to an external force for moving the shutter plate from a first position corresponding to a closed position of the shutter towards a second position corresponding to an open position of the shutter, the external force thereby applied to the worm gear by the worm segment, when above a threshold force value which is lower than a force value determined to cause damage to the mechanism, moves the worm gear of the motor assembly about the pivotable mounting out of engagement with the worm segment thereby preventing damage to the shutter operating mechanism.

BRIEF DESCRIPTION OF THE DRAWINGS

The present invention will now be described by way of example only, with reference to the accompanying drawings.

DETAILED DESCRIPTION

Figure 1:
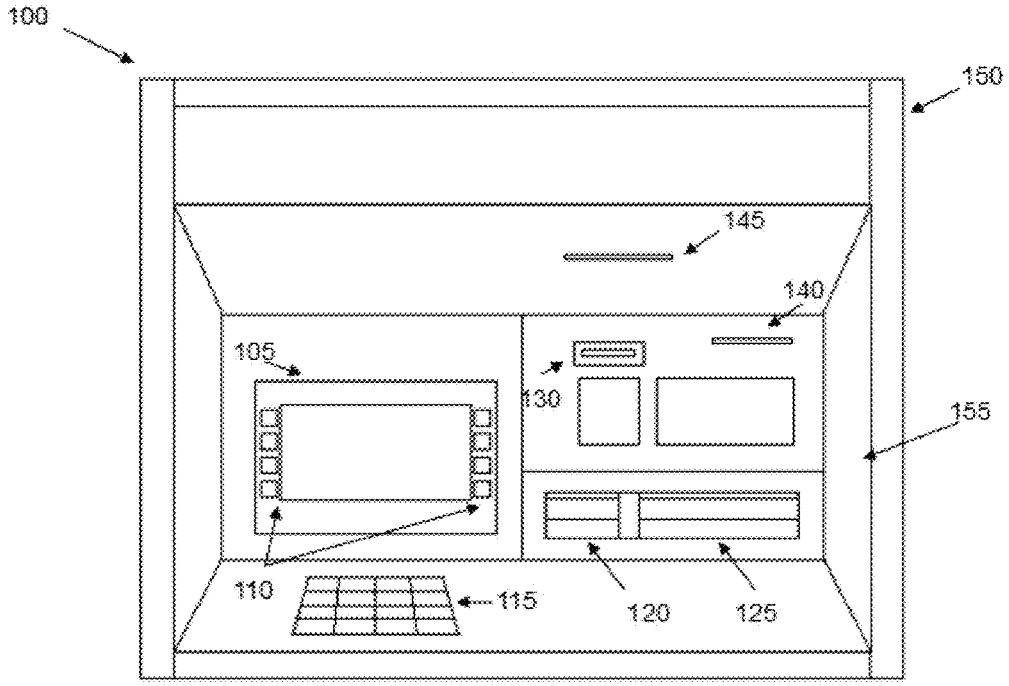
FIG. 1 is an illustration of an outer public face of an automated teller machine (ATM) as is known in the art.

It should be understood that the accompanying drawings are merely schematic and are not drawn to scale. It should also be understood that the same reference numerals are used throughout the description and the drawings to indicate the same or similar parts. Where reference is made to descriptors relating to orientation, such descriptors are used merely for the purposes of clarity and ease of understanding with reference to the drawings and are not intended to limit the scope of the present invention. Embodiments of the present invention may be orientated in any way convenient without departing from the scope of the present invention.

Embodiments of the invention provide a dispenser shutter assembly of an automated teller machine (ATM). The dispenser shutter assembly includes: a frame member; a shutter plate operable for moving between a closed position of a shutter and an open position of the shutter; and a shutter operating mechanism that comprises a motor assembly and a shutter plate. The motor assembly comprises a motor comprising a drive shaft mounting a worm gear. The operating motor assembly is attached to the frame member by an attachment means. The shutter plate is moveable relative to the frame member and comprises a worm segment. The worm segment is engageable with the worm gear so that, upon the worm segment being engaged with the worm gear and the worm gear being rotated by the motor, the worm segment and shutter plate are moveable between a closed position of the shutter and an open position of the shutter by sufficient rotation of the worm gear. The attachment means comprises a pivotable mounting to the frame member so that the worm gear is moveable out of engagement with the worm segment by pivoting of the motor assembly away from the frame member about the pivotable mounting, so that when the shutter plate is subject to an external force for moving the shutter plate from a first position corresponding to a closed position of a shutter towards a second position corresponding to an open position of the shutter, the external force thereby applied to the worm gear by the worm segment, when above a threshold force value which is lower than a force value determined to cause damage to the mechanism, moves the worm gear of the motor assembly about the pivotable mounting out of engagement with the worm segment thereby preventing damage to the shutter operating mechanism.

In an embodiment, the motor assembly is biased towards engagement of the worm gear with the worm segment by a biasing force, and the biasing force is overcome when the external force applied exceeds the threshold value.

In an embodiment, the biasing force is provided by a biasing means.

In an embodiment, the biasing means includes a spring under tension attached between a first mounting point on the motor assembly and a second mounting point on the frame member.

In an embodiment, the pivotable mounting includes a hinged bracket attaching the motor assembly to the frame member.

In an embodiment, a ratcheting action on the motor assembly occurs during opening of the shutter by application of the external force to the shutter plate.

In an embodiment, after application of the external force to open the shutter, the shutter plate is retained in an open position of the shutter by engagement of the worm gear with the worm segment.

In other embodiments, the invention provides an automated teller machine including a dispenser shutter assembly of any of the previous embodiments.

In another embodiment, the invention provides a method of preventing damage to the shutter operating mechanism of the dispenser shutter assembly by pivotably attaching, by a pivotable mounting, the motor assembly to the frame member of the shutter assembly of the automated teller machine.

Figure 2:
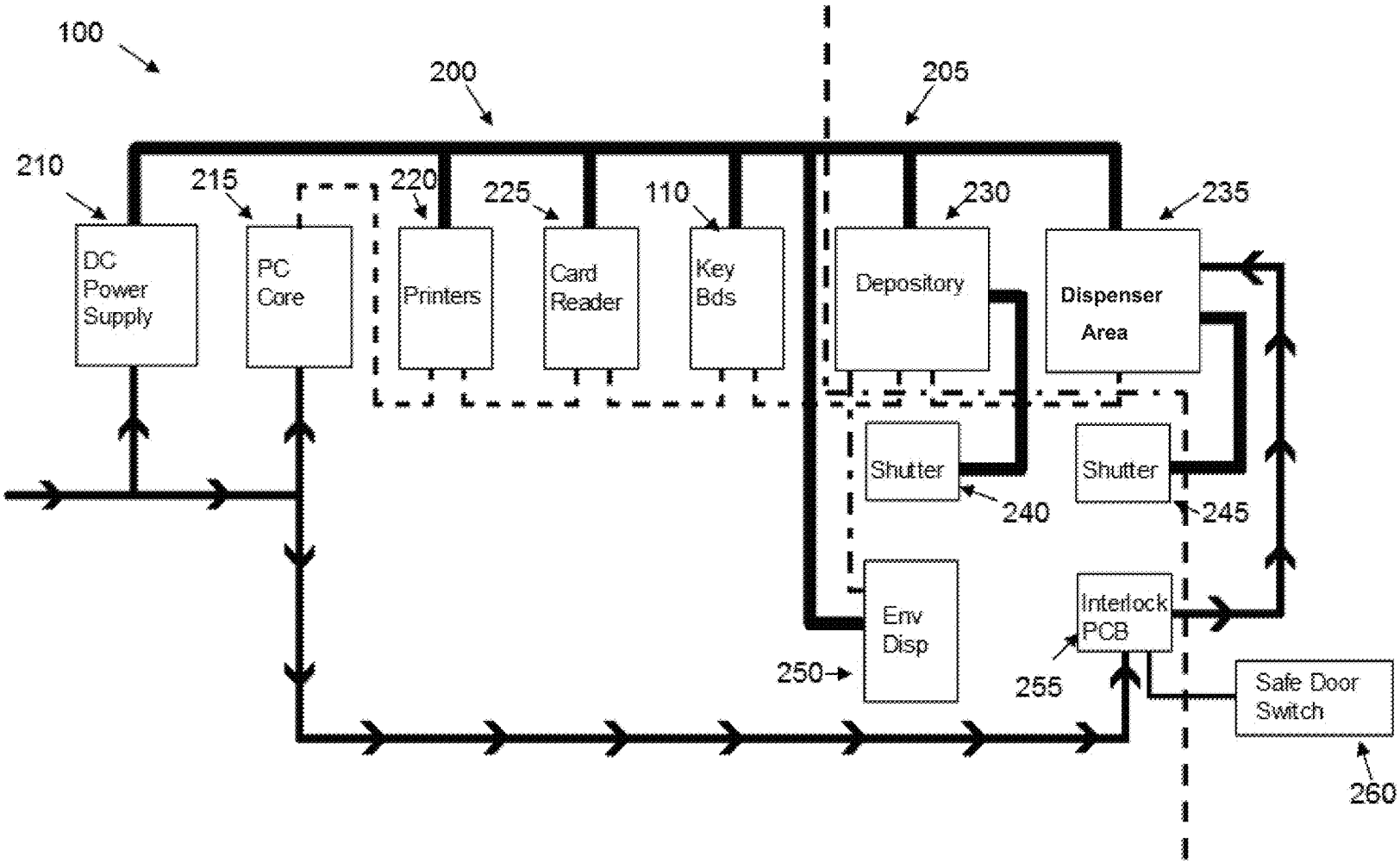
FIG. 2 is a block diagram illustrating an example of the internal components of the automated teller machine of FIG. 1 as is known in the art.

FIG. 1 is an illustration of an outer public face of an automated teller machine (ATM) 100 as is known in the art and FIG. 2 is a block diagram illustrating an example of the internal components of the automated teller machine 100 of FIG. 1 as is known in the art. FIG. 1 and FIG. 2 should be read in conjunction with each other.

The ATM 100 comprises a housing 150 which comprises a non-secure portion 200 and a secure portion 205.

The non-secure portion 200 comprises a further housing having a public outer fascia 155 which comprises a display 105 for displaying user information to a user, screen selection keys 110 and keypad 115 for inputting data, a DC power supply 210, a card reader 225 for receiving a user bank card or other form of identity via a card receiving aperture 130, a cash dispensing aperture 125 and associated shutter assembly 245 for dispensing cash in the form of paper currency processed and stored in a dispenser area 235 of the ATM 100, a deposit aperture 120 for receiving deposits stored in a depository 230 and communicating with a deposit shutter assembly 240, an envelope dispensing aperture 145 for dispensing from envelope dispenser 250 envelopes for holding cash or check deposits for receiving by the deposit aperture 120, a receipt dispensing aperture 140 for dispensing receipts acknowledging a transaction made by a customer, an interlock PCB 255 coupled to a safe door switch 260, and a printer 220 for printing the receipts.

The non-secure portion 200 also houses a data processing apparatus 215 (which may include a PC core) for communicating with each of the components of the ATM 100 in order to process a requested transaction and to control the mechanical components of the ATM 100 in order to complete a requested and authorized transaction.

Figure 3:
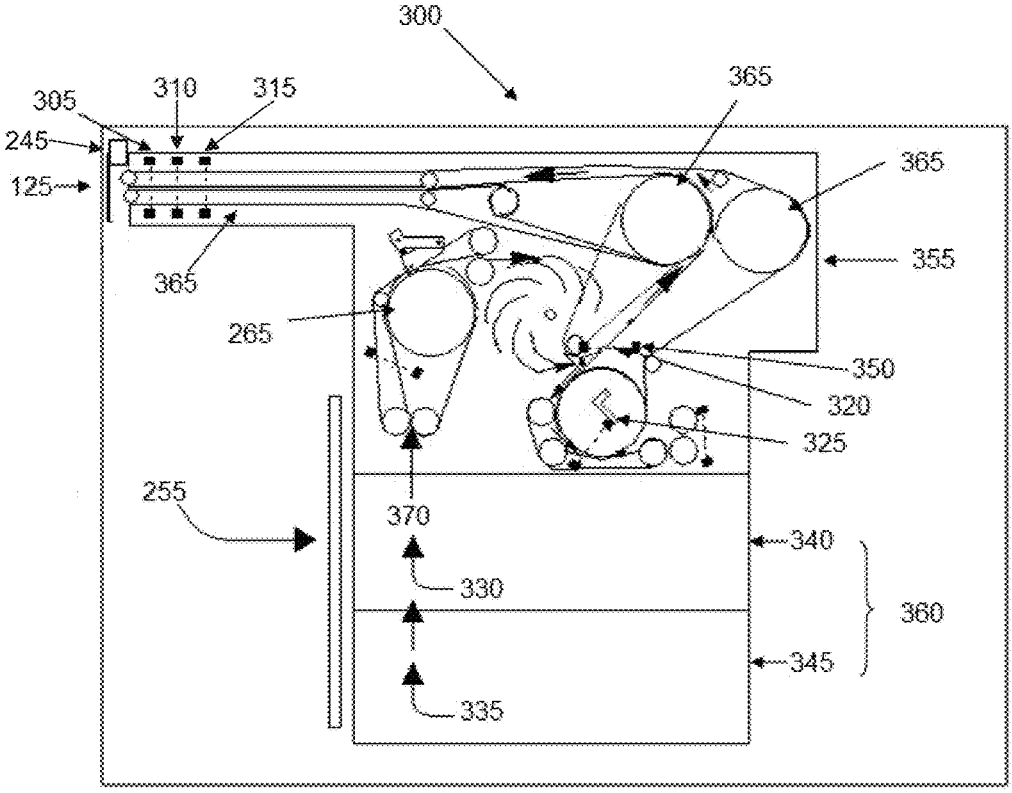
FIG. 3 is a schematic diagram illustrating a side view cross section of an example of an automated teller machine cash dispenser as is known in the art.

FIG. 3 is a schematic diagram illustrating a side view cross section of an example of an automated teller machine cash dispenser as is known in the art. FIG. 3 illustrates the secure portion 205 of FIG. 2 in further detail. The secure portion comprises a safe 300. The safe 300 comprises a housing having a first portion comprising a number of slideably mountable racks for mounting currency cassettes 340, 345 (collectively, 360) for storing paper currency. Paper currency is intended herein to mean UK banknotes, U.S.A dollar bills etc. The actual material of the banknotes may be other than paper, for example a polymer material. A second portion of the housing comprises one or more slideably mountable racks for mounting a presenter unit 355 comprising pick up modules 265 for singly picking-up one or more paper currency until the requested paper currency denomination is reached. The presenter unit 355 also comprises presenter belts 365 for transporting the requested paper currency from the currency cassettes 340, 345 along a transportation path 330, 335, 370 to the dispenser aperture 125. The second portion further comprises a slideably mountable reject tray (not shown) for holding reject paper currency detected by the data processing apparatus 215. The presenter unit 355 also comprises timing disk sensor arm 325 and drive belt 320.

Dispenser area 235 further comprises a number of optical sensors 305, 310, 315 for detecting and validating the presence of paper currency in the presenter area.

For clarity, the dispenser area 235 referred to herein comprises a presenter unit 355, the dispenser shutter assembly 245 and cash dispenser aperture 125. A person skilled in the art will realize that there are many types of internal configurations of an ATM 100 and the above description is not limiting. Many other configurations are possible without departing from the scope of the present invention.

In use a user inserts the user's bank card into the card reader 130 and the display unit 105 requests the user to enter their personal identification number. The data processing apparatus 215 validates the personal identification number and the display unit 105 presents the user with a number of financial transaction options. When a request for cash withdrawal is made and approved, the data processing apparatus 215 sends an instruction to the pickup module 265 which causes the pickup module 265 to obtain the requested paper currency from one or more of the currency cassettes 340, 345. As the individual units of paper currency are requested, the units of paper currency are validated and in response the presenter belts 365 transport the paper currency through the secure housing along a transportation path 330, 335 (following the direction of the arrows) for dispensing to the user through the cash dispenser aperture 125. In one embodiment, when the paper currency is transported along the transportation path, the paper currency passes under various sensors 350, 315, 310 and 305. The sensors perform various functions such as the following functions:

Sensor 350—acknowledges presence of paper currency after the measuring process.

Sensor 315—acknowledges timely arrival of paper currency for dispense.

Sensor 310—acknowledges timing restrictions and initiates a signal for the dispenser shutter to open.

Sensor 305—acknowledges a timing sequence and signals for dispenser shutter to close.

Once the paper currency is transported a predetermined distance from sensor 305, the shutter of the cash dispenser shutter assembly 245 remains open until the user removes the paper currency from the cash dispenser aperture 125. Once the paper currency is removed by the user, the shutter of the cash dispenser shutter 245 closes.

FIGS. 4 to 7 illustrate the front and side views of the operation of a cash dispenser shutter assembly 400 according to a known design. The shutter assembly 400 may be positioned as illustrated by shutter assembly 245 in ATM 300 of FIG. 3. Shutter assembly 400 comprises a shutter plate 420 and a shutter aperture 410, for example a cash dispenser aperture positioned similarly to dispenser aperture 125 of ATM 100 of FIG. 1. Shutter plate 420 is operable for moving in a vertical direction between a first position to restrict and a second position to allow access to shutter aperture 410. These first and second positions appear to a user of the ATM as respectively shutter closed and shutter open positions. Shutter aperture 410 is operable for dispensing paper currency to the user in the shutter open position.

Figure 4:
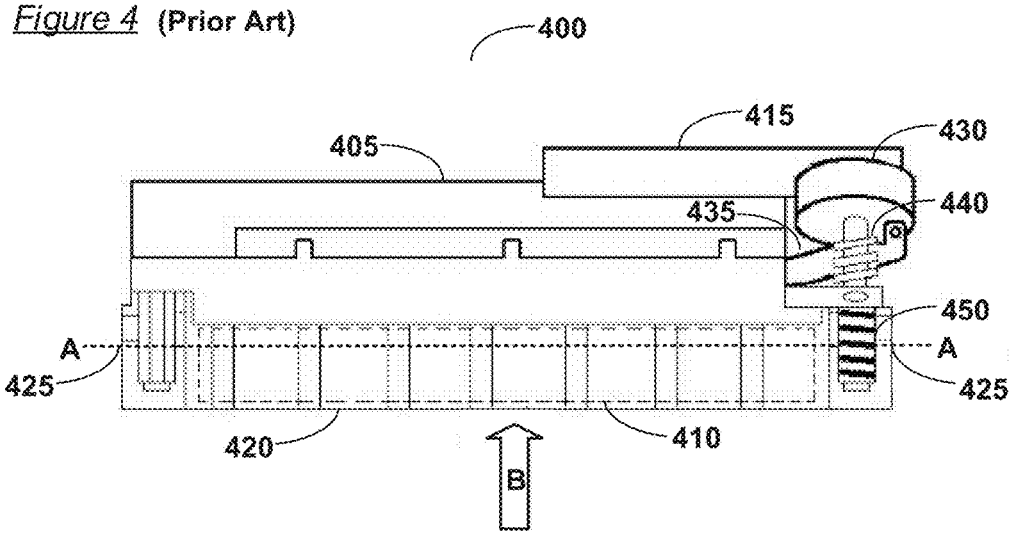
Figure 4 (Prior Art)
FIG. 4 is an illustration of a front view of the shutter assembly of a known automated teller machine with a dispenser shutter in the closed position.

FIG. 4 illustrates a front view of the shutter assembly 400 with the dispenser shutter in the first or closed position. The shutter operating mechanism of shutter assembly 400 is mounted on ATM frame 405. The shutter operating mechanism comprises a rotary electrical motor 430 and associated electrical control printed circuit board (PCB) 415. Control PCB 415 receives signals from ATM control circuitry for actuating motor 430 appropriately responsive to "shutter open" and "shutter close" signals from the ATM control circuitry. Motor 430 comprises together with worm gear 440 a motor assembly 435. The drive shaft of motor 430 mounts the worm gear 440 operable for rotating by motor 430. Shutter plate 420 comprises worm segment 450 operable for meshing with worm gear 440. Reference numeral 425 denotes a pivoting joint.

Figure 5:
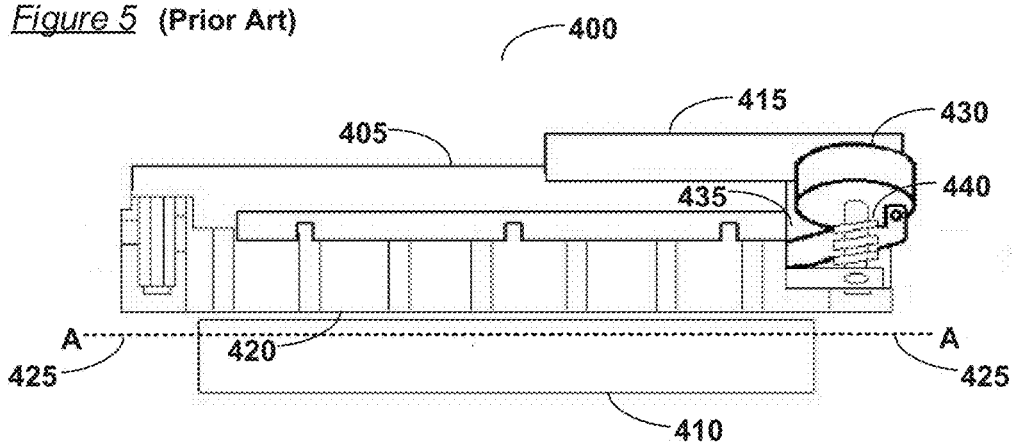
Figure 5 (Prior Art)
FIG. 5 is an illustration of the front view of the shutter assembly of FIG. 4 with the dispenser shutter in the open position.

FIG. 5 illustrates the front view of shutter assembly 400 with the dispenser shutter in the second or open position. To move from the first position shutter closed state of FIG. 4 to the second position shutter open state of FIG. 5, motor 430 sufficiently rotates worm gear 440 counter clockwise (as viewed towards the motor from the worm gear). Interaction with worm segment 450 attached to shutter plate 420 causes shutter plate 420 to move from the first or shutter closed position in direction of arrow B of FIG. 4 towards the second or shutter open position of FIG. 5. Motor 430 sufficiently rotates worm gear 440 clockwise to reverse the process to move shutter plate 420 in the opposite direction to arrow B from the second or shutter open position to the first or shutter closed position of the shutter.

Figure 6:
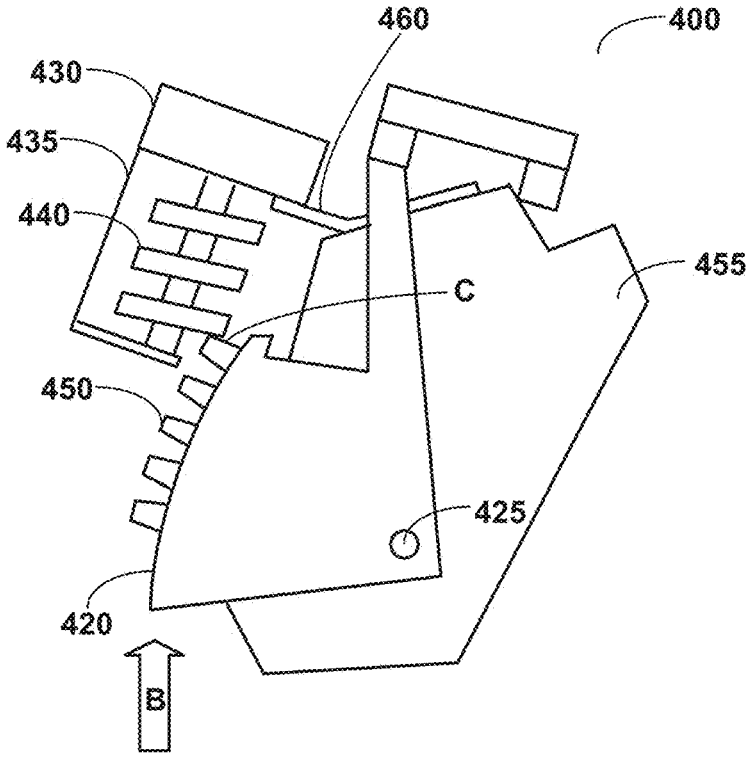
Figure 6 (Prior Art)
FIG. 6 is an illustration of a side view of the shutter assembly of FIG. 4 with the dispenser shutter in the closed position.
Figure 7:
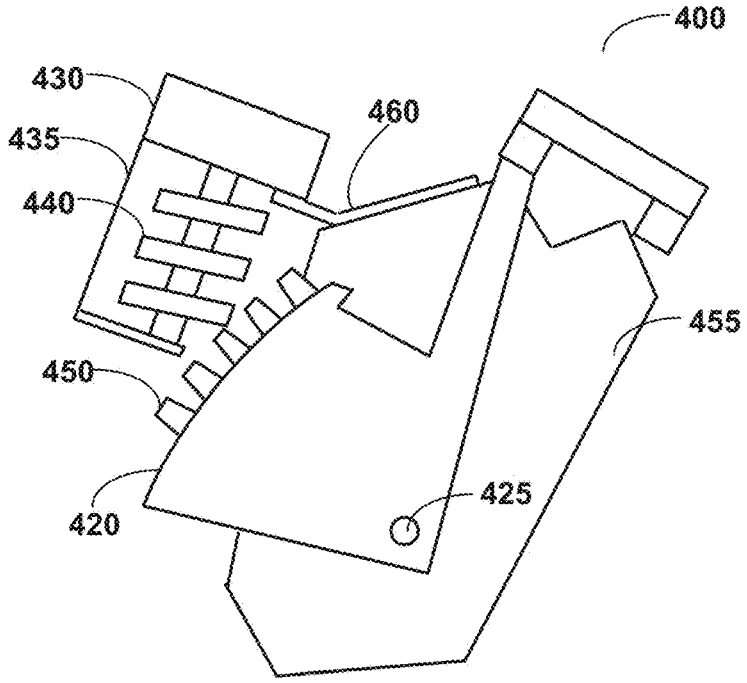
Figure 7 (Prior Art)
FIG. 7 is an illustration of the side view of the shutter assembly of FIG. 6 with the dispenser shutter in the open position.

FIGS. 6 and 7 illustrate the side views of shutter assembly 400 in the states of FIGS. 4 and 5 respectively. Specifically, FIG. 6 is an illustration of a side view of the shutter assembly of FIG. 4 with the dispenser shutter in the closed position, and FIG. 7 is an illustration of the side view of the shutter assembly of FIG. 6 with the dispenser shutter in the open position.

Shutter plate 420 is mounted to ATM frame member 455 by pivoting joint 425. Motor assembly 435 comprising motor 430 and worm gear 440 is mounted by mounting bracket 460 to ATM frame member 455. Shutter plate 420 is operable for sufficiently rotating movement pivoting about axis of rotation A-A to describe an arc of movement in moving in direction of arrow B of FIG. 6 between the shutter closed state of FIG. 6 and the shutter open state of FIG. 7. Position of pivoting joint 425 and axis of rotation A-A are shown by the dashed line in FIGS. 4 and 5. As illustrated, a separate pivoting joint 425 is present at each end of shutter plate 420 attaching shutter plate 420 to frame member 455. To move from the shutter closed state of FIG. 6 to the shutter open state of FIG. 7, motor 430 rotates worm gear 440 as described with reference to FIGS. 4 and 5.

Figure 8:
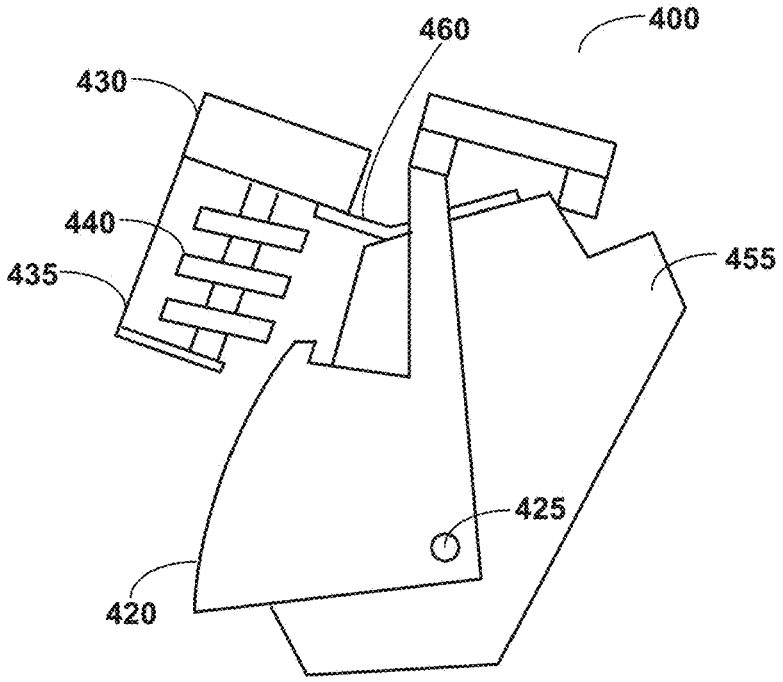
Figure 8 (Prior Art)
FIG. 8 is an illustration of a side view of the shutter assembly of the known art in the aftermath of a forced opening of the shutter.

FIG. 8 is an illustration of a side view of the shutter assembly 400 of the known art in the aftermath of a forced opening of the shutter. FIG. 8 illustrates the aftermath of an attempted fraudulent forced opening of shutter plate 420 of shutter assembly 400. A fraudulent user may attempt to force open shutter plate 420 by, for example, inserting a lever member below shutter plate 420 to move shutter plate 420 in direction of arrow B. Worm gear 440 is stationary and not free to rotate because motor 430 is not operating, which results in application of a force at position C in FIG. 6. When a force threshold is exceeded by the force at position C, breakage occurs, resulting usually in the stripping of elements of worm segment 450 from shutter plate 420. Shutter plate 420 now moves in direction of arrow B to expose shutter aperture 410. After the fraudulent access, shutter plate 420 is not retained in the open state by interaction of stationary worm gear 430 and worm segment 440 because of damage, probably to the worm segment 440. Damaged shutter plate 420 returns to the closed position shown in FIG. 8, and ATM shutter assembly 400 is no longer operable by legitimate ATM operation and will be out of service requiring repair by a maintenance operator.

Figure 9:
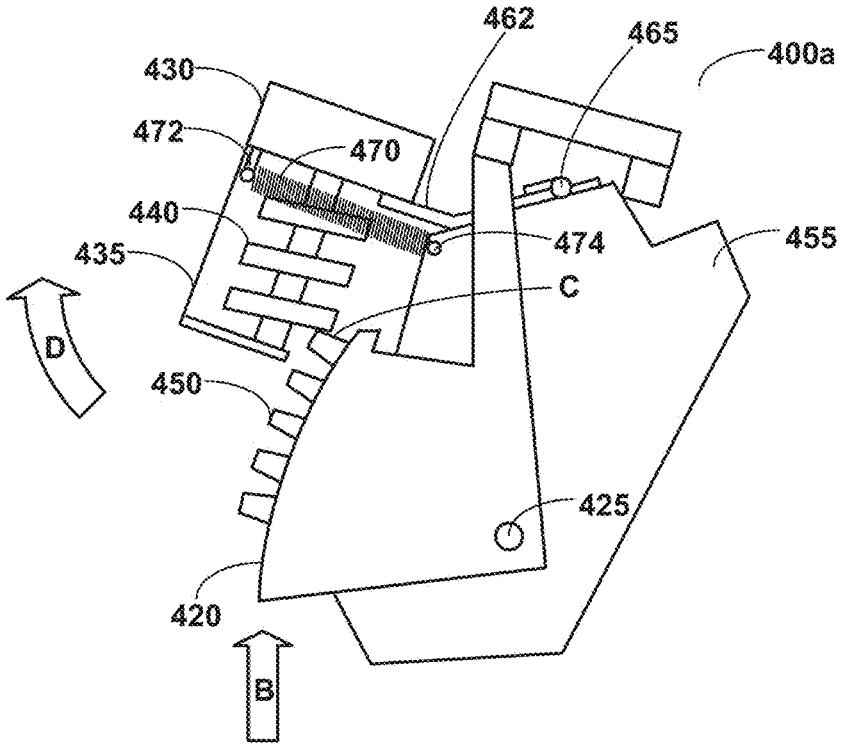
FIG. 9 is an illustration of a side view of a shutter assembly, in accordance with an embodiment of the present invention.

FIG. 9 is an illustration of a side view of a shutter assembly 400*a*, in accordance with an embodiment of the present invention. FIG. 9 illustrates an embodiment of the present invention comprising shutter assembly 400*a* which addresses the preceding problem illustrated in FIG. 8. In the embodiment, motor assembly 435 comprising motor 430 and worm gear 440 is attached to frame member 455 by mounting bracket 462. Mounting bracket 462 is fixedly attached to motor assembly 435 comprising motor 430 and worm gear 440 in similar manner to the bracket 460. Mounting bracket 462 differs from mounting bracket 460 of the prior art of FIGS. 6 to 8 in attachment means for attaching motor assembly 435 to frame member 455. Mounting bracket 462 attaches motor assembly 435 comprising motor 430 and worm gear 440 to frame member 455 by a pivotable attachment means. In the illustrated embodiment, the pivotable attachment means comprises a pivotable joint 465, for example comprising a hinged joint. Pivotable joint 465 allows motor assembly 435 to pivot about the pivotable axis of pivotable joint 465 so as to describe an arc of movement shown by arrow D in FIG. 9 and thereby to move worm gear 430 away from engagement with worm segment 450 of shutter plate 420.

In embodiments of the present invention, the pivotable attachment means comprising pivotable joint 465 is arranged so that when the shutter plate is subject to an external force for moving the shutter plate from a first position corresponding to a closed position of the shutter towards a second position corresponding to an open position of the shutter, the motor assembly may pivot about the pivotable mounting out of engagement with the worm segment 450, thereby preventing damage to the shutter operating mechanism when the external force applied to the worm gear 440 by the worm segment 450 is above a threshold force value which is lower than a force value which is determined to cause damage to the shutter operating mechanism.

In an embodiment, shutter assembly 400*a* further comprises a biasing means operable for biasing motor assembly 435 comprising motor 430 and worm gear 440 towards engagement of worm gear 440 with worm segment 450 of shutter plate 420. In the illustrated embodiment of FIG. 9, the biasing means comprises a spring 470 attaching motor assembly 435 to frame member 455. The biasing means comprising spring 470 is attached at a first attachment point 472 to motor assembly 435 and at a second attachment point 474 to frame member 455 so that spring 470 is in tension between the two attachment points 472 and 474 to provide a biasing force.

Figure 10:
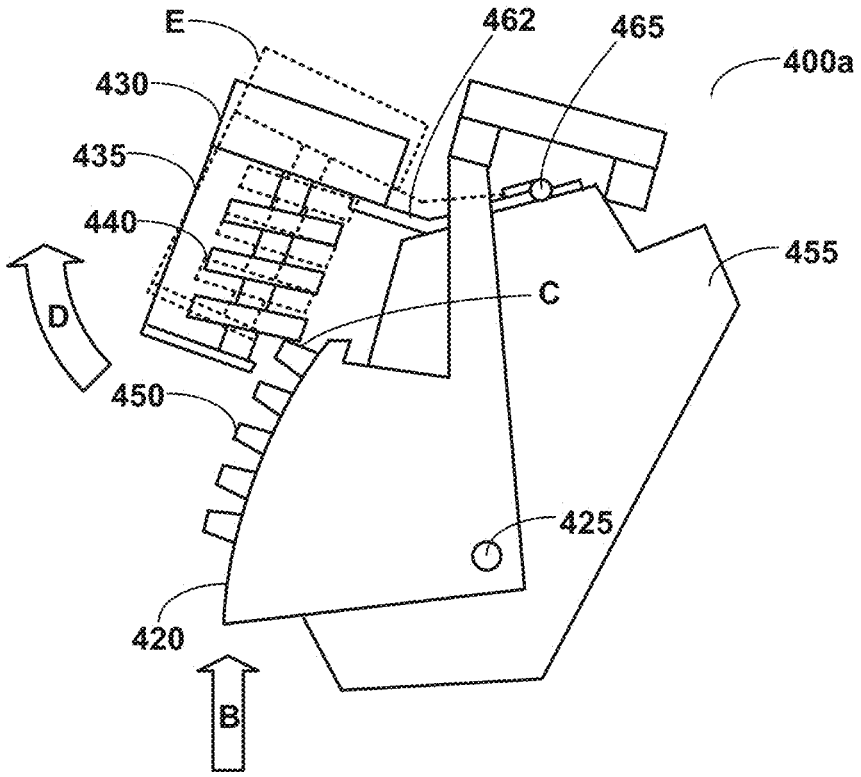
FIG. 10 is an illustration of the side view of the shutter assembly of FIG. 9 showing an operation of an embodiment of the present invention.
Figure 11:
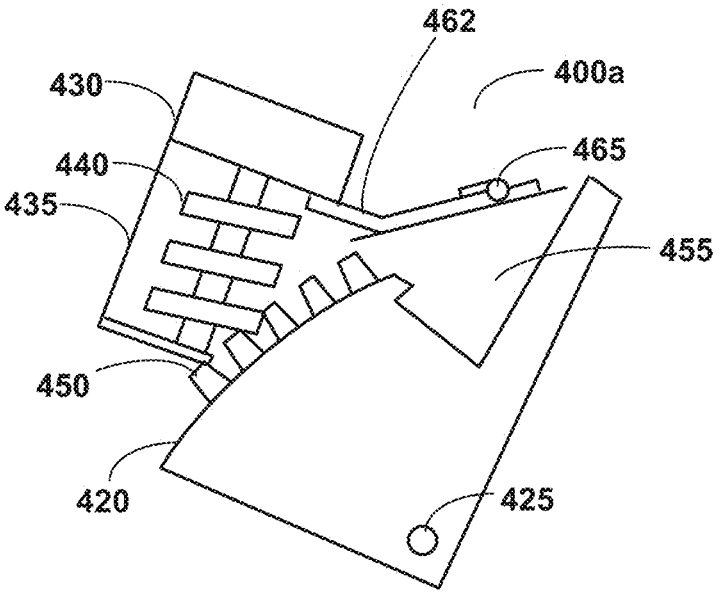
FIG. 11 is an illustration of the side view of the shutter assembly of FIG. 9 in the aftermath of the operation of an embodiment of the present invention.

FIGS. 10 and 11 illustrate operation of embodiments of the invention. Specifically, FIG. 10 is an illustration of the side view of the shutter assembly of FIG. 9 showing an operation of an embodiment of the present invention, and FIG. 11 is an illustration of the side view of the shutter assembly of FIG. 9 in the aftermath of the operation of an embodiment of the present invention.

When a fraudulent user attempts to open shutter plate 420 by exerting an external force in direction of arrow B as shown in FIG. 10, worm segment 450 exerts the external force against worm gear 440 at position C. In the embodiment, the biasing force of the biasing means is overcome when a threshold force is exceeded at position C by the external force. The biasing force is set by appropriate design of the bias so that the biasing force is overcome when the external force exceeds the threshold value.

When the exerted external force exceeds the threshold value so that the biasing force is overcome, motor assembly 435 comprising motor 430 and worm gear 440 mounted by mounting bracket 462 to frame member 455 pivots about pivotable joint 465 to move in direction of arrow D of FIG. 10 and so away from worm segment 450 of shutter plate 420. At this point motor assembly 435 occupies the position E as shown by a dashed outline in FIG. 10. In the illustrated embodiment of FIG. 9 where the biasing means includes a spring 470 under tension, the spring 470 stretches to allow pivoting of motor assembly 435 about pivotable joint 465. When worm segment 450 has moved sufficiently in direction B for a given portion of worm gear 440 to engage with the next gap between teeth of worm segment 450, biasing means 470 causes worm gear 440 to engage again with worm segment 450 by moving in the reverse of direction D. The movement which ensues when this process is repeated successively comprises a ratcheting action, with successive pivoting of the worm gear 440 out of engagement with the worm segment 450, followed byre-engagement of the worm gear 440 with the worm segment 450. Rather than damaging the mechanism, worm gear 440 rides over worm segment 450 as shutter plate 420 is moved in direction of arrow B. When application of external force to move shutter plate 420 from the first or closed position towards the second or open position stops, worm gear 440 engages with worm segment 450 at the current position of shutter plate 420 so as to retain shutter plate 420 in the current position of shutter plate 420.

FIG. 11 illustrates the position of shutter plate 420 in the shutter open state after the shutter plate 420 has been moved to an open position of the shutter. Mounting bracket 462 has pivoted repeatedly about pivotable joint 465 in the ratcheting action described above with reference to FIG. 10. Worm segment 450 and worm gear 440 are not damaged because of this ratcheting action. The state after forcing open of shutter plate 420 is worm gear 440 engaging worm segment 450 and with shutter plate 420 stationary in a shutter open position. In an embodiment, ATM control logic disables shutter operation with shutter plate 420 in the shutter open position, and ATM operation is thereby disabled. A fraudulent user cannot close the shutter to give the appearance of an operational ATM. Because the shutter mechanism remains undamaged, recovery of the ATM to an operational state may be effected via a simple dispenser test operation of ATM control logic without requiring repair by a maintenance operator.

In a further embodiment, a method of preventing damage to the shutter operating mechanism of a dispenser shutter assembly 400*a* for an ATM is provided. The method comprises pivotably attaching the shutter operating motor assembly 435 of the ATM to the frame member 455 of the shutter assembly so that a shutter operating worm gear 440 is moveable out of engagement with a shutter plate worm segment 450 by pivoting of the motor assembly 435 away from the frame member 455 about the pivotable mounting. When the shutter plate 420 is subject to an external force, for example in an operation for fraudulently opening the shutter, the external force thereby applied to the worm gear 440 by the worm segment 450, when above a threshold force value, moves the worm gear 440 of the motor assembly 435 about the pivotable mounting out of engagement with the worm segment 450. The threshold force is set to be lower than a force value which is determined to cause damage to the mechanism. Damage to the shutter operating mechanism during a fraudulent forcing of the shutter to an open position is thereby prevented.

It will be apparent that variations and modifications to the above may be envisaged by the skilled person without departing from the scope of the invention. For example, although described as a single pivotable mounting bracket, bracket 462 may comprise a plurality of pivotable mounting brackets. Alternative designs of bracket may be envisaged using other forms of pivoting or rotary attachment. Alternative designs and positioning of the biasing means may also be envisaged, for example associated with or positioned within an alternative design of mounting bracket. Alternative means of attachment of motor assembly 435 to frame member 455 other than a bracket may be envisaged without departing from the scope of the invention. Any suitable attachment means may be used which provides pivoting movement. In alternative embodiments, the ATM may remain in a disabled state after the fraudulent opening and require external intervention to restore normal operation.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others or ordinary skill in the art to understand the embodiments disclosed herein.

What is claimed is:

1. A dispenser shutter assembly of an automated teller machine (ATM), said dispenser shutter assembly comprising:

a frame member;

a shutter operating mechanism comprising a motor assembly and a shutter plate comprising a motor comprising a drive shaft mounting a worm gear, said motor assembly attached to the frame member by an attachment means, said shutter plate moveable relative to the frame member and comprising a worm segment, said worm segment engageable with the worm gear so that, upon the worm segment being engaged with the worm gear and the worm gear being rotated by the motor, the worm segment and shutter plate are moveable between a closed position of the shutter and an open position of the shutter by sufficient rotation of the worm gear;

said attachment means comprising a pivotable mounting to the frame member so that the worm gear is moveable out of engagement with the worm segment by pivoting of the motor assembly away from the frame member about the pivotable mounting, so that when the shutter plate is subject to an external force for moving the shutter plate from a first position corresponding to a closed position of the shutter towards a second position corresponding to an open position of the shutter, the external force thereby applied to the worm gear by the worm segment, when above a threshold force value which is lower than a force value determined to cause damage to the mechanism, moves the worm gear of the motor assembly about the pivotable mounting out of engagement with the worm segment thereby preventing damage to the shutter operating mechanism.

2. The dispenser shutter assembly of claim 1, wherein the motor assembly is biased towards engagement of the worm gear with the worm segment by a biasing force, and wherein the biasing force is overcome when the external force exceeds the threshold force value.

3. The dispenser shutter assembly of claim 2, wherein the biasing force is provided by a biasing means.

4. The dispenser shutter assembly of claim 3, wherein the biasing means comprises a spring under tension attached between a first mounting point on the motor assembly and a second mounting point on the frame member.

5. The dispenser shutter of claim 1, wherein the pivotable mounting comprises a hinged bracket attaching the motor assembly to the frame member.

6. The dispenser shutter assembly of claim 1, wherein a ratcheting action on the motor assembly occurs during opening of the shutter by application of the external force to the shutter plate.

7. The dispenser shutter assembly of claim 1, wherein after application of the external force to open the shutter, the shutter plate is retained in the open position of the shutter by engagement of the worm gear with the worm segment.

8. An apparatus consisting of the automated teller machine that comprises the dispenser shutter assembly of claim 1.

9. A method of preventing damage to the shutter operating mechanism of the dispenser shutter assembly of claim 1, said method comprising:

pivotably attaching, by the pivotable mounting, the motor assembly to the frame member so that the worm gear is moveable out of engagement with the worm segment by pivoting of the motor assembly away from the frame member about the pivotable mounting, so that when the shutter plate is subject to an external force for moving the shutter plate from a first position corresponding to a closed position of the shutter towards a second position corresponding to an open position of the shutter, the external force thereby applied to the worm gear by the worm segment, when above a threshold force value which is lower than a force value determined to cause damage to the mechanism, moves the worm gear of the motor assembly about the pivotable mounting out of engagement with the worm segment thereby preventing damage to the shutter operating mechanism.

* * * * *